US006948574B2

(12) United States Patent
Cramer et al.

(10) Patent No.: US 6,948,574 B2
(45) Date of Patent: Sep. 27, 2005

(54) ULTRASONIC ANNULAR CORE BIT

(75) Inventors: Till Cramer, Feldkirch (AT); Adrian Kauf, Wangen (DE); Stefan Tichy, Unterterzen (CH); Walter Littmann, Aerzen-Grupenhagen (DE); John van Taack-Trakranen, Munich (DE); Peter Alberg, Kaufering (DE)

(73) Assignee: Hilti Aktiengesellschaft, Schaan (LI)

( * ) Notice: Subject to any disclaimer, the term of this patent is extended or adjusted under 35 U.S.C. 154(b) by 15 days.

(21) Appl. No.: 10/322,825

(22) Filed: Dec. 18, 2002

(65) Prior Publication Data

US 2003/0146024 A1 Aug. 7, 2003

(30) Foreign Application Priority Data

Dec. 20, 2001 (DE) ..... 101 62 636

(51) Int. Cl.[7] ..... E21B 10/02

(52) U.S. Cl. ..... 175/403; 175/55; 175/56; 408/204; 408/206; 408/207

(58) Field of Search ..... 175/20, 55, 56, 175/403; 408/203, 207, 208, 209, 204, 206

(56) References Cited

U.S. PATENT DOCUMENTS

| | | | | |
|---|---|---|---|---|
| 4,697,117 A | | 9/1987 | Mishiro | |
| 4,828,052 A | * | 5/1989 | Duran et al. | 175/55 |
| 4,966,502 A | * | 10/1990 | Magyari | 408/59 |
| 5,171,111 A | * | 12/1992 | Kishimoto | 408/67 |
| 5,733,074 A | | 3/1998 | Stoeck | |
| 5,813,802 A | * | 9/1998 | Ajimi et al. | 408/68 |

* cited by examiner

*Primary Examiner*—David Bagnell
*Assistant Examiner*—Giovanna Collins
(74) *Attorney, Agent, or Firm*—Abelman, Frayne & Schwab

(57) ABSTRACT

A core bit for abrasive cutting including a cylindrical tube (3) provided at its end surface with cutting or abrasive bodies (2) and a cover (4) provided at an opposite end surface of the cylindrical tube (3) and secured thereto and having, along its central axis (A), a shank (5) to be received in a rotary power tool, with the cover (4) being dimensioned, with respect to a set excitation frequency, for forming a whole number of maximum amplitude oscillations of a concentric flexural oscillation, and the cylindrical tube (3) being dimensioned, with respect to a set excitation frequency, for forming a whole number of maximum amplitude oscillations of axial longitudinal oscillations.

6 Claims, 1 Drawing Sheet

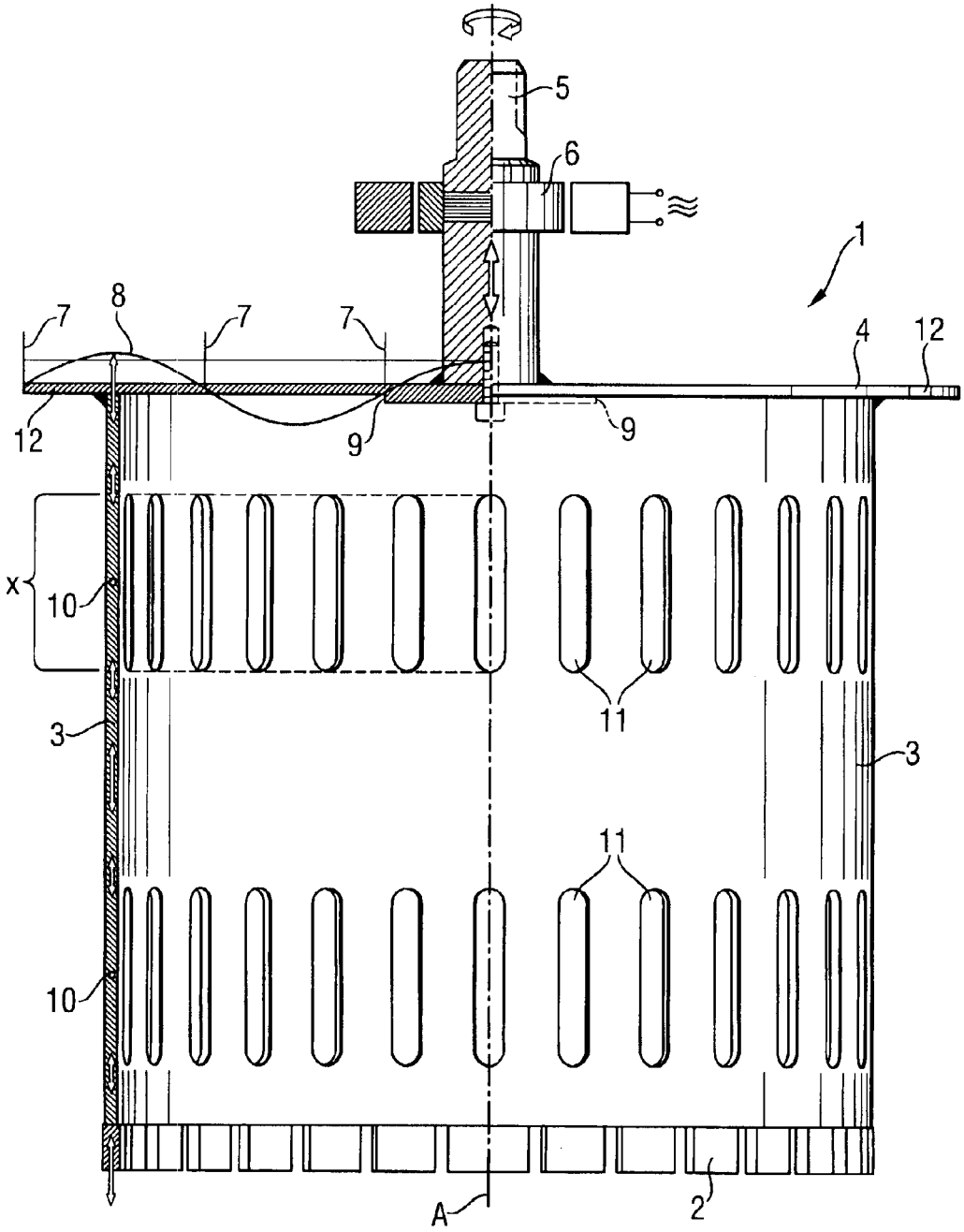
5
6
1
7
8
7
7
4
12
12
9
9
x
10
11
3
3
11
10
A
2

ULTRASONIC ANNULAR CORE BIT

BACKGROUND OF THE INVENTION

1. Field of the Invention

The present invention relates to a rotatable about an axis of symmetry, ultrasonic annular core bit provided with cutting or abrasive bodies for abrasive cutting mineral components formed, e.g., of stone and having axial ultrasonic excitation.

2. Description of the Prior Art

Usually, a pot-shaped, annular core bit includes a cylindrical tube provided with abrasive bodies at its end side, and a cover provided at the opposite end side of the cylindrical tube and secured thereto and having, in its center, a shank to be received in a rotary power tool. Upon a conventional superimposition of ultrasound in the range from 20 kHz to 200 kHz at the natural frequency of the core bit, the bit will be excited in its center by an actor in the shank provided in the cover. Such core bits can be only realized with cylindrical tubes having only a small diameter up to 100 mm. This is because upon engaging the to-be-cut component, with a larger diameter of the tube, i.e., with a large ratio of the tube diameter to the excitation diameter of the actor, no robust axial longitudinal oscillations are excited, in particular, with high damping imparted to the cylindrical tube by axial forces necessary for effecting an abrasive cutting.

German Publication DE-3812917 discloses a slot borer driver with not a specified, natural frequency and having a plurality of elongate offerings formed in the annular crown.

German Publication DE-3635806 discloses a tool with a regulated ultrasonic vibrator and provided with a plurality of equidistant elongate slots in a cylindrical base body, with the webs acting as pure longitudinal oscillators.

German Publication DE-4444853 discloses an annular core bit having a cylindrical tube with a cover in the center of which a natural frequency is applied to provide for axial flexural oscillation. At that, a grinding disc, which is subjected to the flexural oscillations and has a thickness that deviates from abrasive bodies, has a concentric projection in a geometrically nondefined location.

German Publication DE-19758243 discloses an ultrasonic transducer for increasing a directive efficiency of a flat, flexurally oscillating plate subjected to the action of a sound field and having, in its center, a projection provided on the nodal circle of amplitude oscillations.

An object of the present invention is to provide an annular core bit having a large diameter and characterized at a central, axial ultrasonic excitation, by a robust excitation behavior for exciting axial longitudinal oscillations in the cylindrical tube.

Another object of the present invention is to provide an annular bit with an increased axial oscillation amplitude at the axial end of the cylindrical tube.

SUMMARY OF THE INVENTION

These and other objects of the present invention, which will become apparent hereinafter, are achieved by providing a core bit having a cylindrical tube provided at its end surface with cutting or abrasive bodies and a cover provided at an opposite end surface of the cylindrical tube and secured thereto and having, along its central axis, a shank to be received in at least rotary power tool, with cover being dimensioned, with respect to a set excitation frequency, for forming a whole number of maximum amplitude oscillations of a concentric flexural oscillation, and with the cylindrical tube being dimensioned, with respect to a set excitation frequency, for forming a whole number of maximum amplitude oscillations of axial longitudinal oscillations The combination of separate parts, the cover and the cylindrical tube, dimensioned in accordance with a set excitation frequency, insures a robust excitation behavior of the annular core bit with an axial ultrasonic excitation.

Advantageously, the cover has a concentric projection in a vicinity of a location of the nodal circle of amplitude oscillation of the concentric flexural oscillation.

The provision of the concentric projection in the vicinity of the location of the nodal circle of amplitude oscillations leads to an amplitude transformation with a significant increase of the amplitude of nodal points at a location where the projection extends into the cylindrical tube. As a result, axial longitudinal oscillations with a significantly increased amplitude are excited in the cylindrical tube, so that the cylindrical tube is adequately excited. The nodal circle of the amplitude oscillation is located in the vicinity of the location of the amplitude oscillation nodes of the concentric radial waves which results, with a radial projection, in a small displacement of the position of the amplitude oscillation nodes.

In practice, the annular core bits are dimensioned, preferably, altogether to two or three amplitude oscillation nodes with respect to a set oscillation frequency of, e.g., 20 kHz. An advantageous thickness ratio of the radially outer side of the projection to the radially inner side from 0.2 to 0.4 is determined for the position of the projection with respect to the relative radius region of the associated nodes, according to the following table (with optimum being indicated in parentheses):

| Amplitude oscillation nodes altogether | Number of nodes on the projection | Relative radius of the projection | Thickness ratio of the projection |
|---|---|---|---|
| 3 | 1 | .25–.40 (.30) | .2–.4 (.30) |
| 3 | 2 | .50–.70 (.60) | .2–.4 (.33) |
| 2 | 3 | .70–.90 (.82) | .2–.4 (.33) |

According to an alternative embodiment, in the annular core bit having a cylindrical tube provided at its end surface with one of cutting or abrasive bodies and a cover provided at an opposite end surface of the cylindrical tube and secured thereto and having, along its central axis thereof, a shank to be received in a rotary power tool, there is provided in the cylindrical tube, in an axial region of axial longitudinal amplitude oscillation nodes, with a plurality of elongate recesses oriented along the central axis and equidistantly arranged over a circumference of the cylindrical table with the provision of the elongate recesses, the cylindrical shell webs therebetween are not any more circumferentially connected with each other with respect to the oscillation which suppresses excitation of parasitic, energy consuming, radial nodes. However, with the cylindrical shell webs being circumferentially connected in the region of longitudinal self-oscillation nodal points, the core bit has a natural or resonant frequency corresponding to a frequency of a thin longitudinal oscillator which differs from a cylindrical tube. The additional energy leads to axial longitudinal oscillations with a significantly higher amplitude resulting in adequately robust excitation. The wave length of the longitudinal oscillations, which is necessary for determining the axial region of the recesses, at a frequency f, is determined from an equation $\lambda=c/f$, where c—the longitudinal wave velocity, is determined form an equation $c=\sqrt{E/\rho}$, where E—is module of elasticity, and ρ—thickness. Advantageously, for a cylindrical tube formed as an λ-oscillator, a mean axial position of the recesses corresponds to one-fourth and/or three-fourths of their relative length.

Advantageously, the elongate recesses extend parallel to the tube axis, which prevents excitation of parasitic shear modes.

Advantageously, the elongate recesses are formed as elongate slots, which completely suppresses radial modes.

Advantageously, the cover has a concentric projection in a vicinity of a location of a nodal circle of amplitude oscillations of the concentric flexural oscillation, which further increases the amplitude.

Advantageously, the cylindrical tube has, solely in an axial region of axial longitudinal amplitude oscillation nodes, a plurality of elongate recesses oriented along the central axis and equidistantly arranged over a circumference of the cylindrical tube.

In addition to a cover that directly covers the cylindrical tube, advantageously, there is provided a cover with a collar projecting radially beyond the cylindrical tube, advantageously, by a one-fourth of the wave length of the flexural oscillation. This additionally eliminates radial modes excited in the cylindrical tube.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

BRIEF DESCRIPTION OF THE DRAWINGS

In the Drawings:

Single FIGURE of the drawings show a partially cross-sectional elevation view of an ultrasonic core bit according to the present invention.

DETAILED DESCRIPTION OF THE PREFERRED EMBODIMENT

A large diameter ultrasonic annular core bit 1 according to the present invention, which is shown in the drawing, has a thin-wall cylindrical tube 3 provided with a plurality of abrasive bodies 2 at one end of its end side, and a thin-wall cover 4 secured to another, opposite end side of the cylindrical tube 3. The cover 4 is provided with a shank 5 to e received formlockingly in a chuck of a power tool (not shown). The shank 5 is arranged symmetrically with respect to the cylindrical tube 3 and the cover 4 and has its axis coinciding with the axis A of the core bit 1. Within the shank 5, there is arranged a schematically shown portion of electroacoustic actor 6 in form of a piezoconverter fed with inductive voltage from a phase transformer. The portion of the actor 6 in the shank 5 serves for inciting an axial ultrasonic oscillation. The cover 4 has, at a radial point of a nodal circle 7 of amplitude oscillations, a flexural self-oscillation 8 having an amplitude maximum on the axis of symmetry A and at projection 9 of the cover 4 into the cylindrical tube 3.

In the cylindrical tube 3, in an axial region X of the axial longitudinal self-oscillation nodes 10 with an expansion maximum, at both end surfaces, there are formed elongate recesses 11 in form of elongate slots and which are arranged equidistantly from each other and parallel to the axis of symmetry A. They are positioned at ¼ and/or ¾ of the relative length.

The cover 4 has a collar 12, which projects radially beyond the cylindrical tube 3 by one-fourth of the wave length of the flexural self-oscillation 8.

Though the present invention was shown and described with references to the preferred embodiment, such is merely illustrative of the present invention and are not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A core bit for an abrasive cutting of mineral components, comprising a cylindrical tube (3) provided at an end surface thereof with one of cutting bodies and abrasive bodies (2); and a cover (4) provided at an opposite end surface of the cylindrical tube (3) and secured thereto and having, along a central axis (A) thereof, a shank (5) to be received in at least rotary power tool, wherein cover (4) is dimensioned, with respect to a set excitation frequency, for forming a whole number of maximum amplitude oscillations of a concentric flexural oscillation, wherein the cylindrical tube (3) is dimensioned, with respect to said set excitation frequency, for forming a whole number of maximum oscillations of axial longitudinal oscillations, and wherein the cylindrical tube (3) has, solely in a axial region (X) of axial longitudinal amplitude oscillation nodes (10), a plurality of elongate recesses (11) oriented along the central axis (A) and equidistantly arranged over a circumference of the cylindrical tube (3).

2. A core bit according to claim 1, wherein the elongate recesses (11) extent parallel to the central axis (A).

3. A core bit according to claim 2, wherein the elongate recesses (11) are formed as elongate slots.

4. A core bit for an abrasive cutting of mineral components, comprising a cylindrical tube (3) provided at an end surface thereof with one of cutting bodies and abrasive bodies (2); and a cover (4) provided at an opposite end surface of the cylindrical tube (3) and secured thereto and having, along a central axis (A) thereof, a shank (5) to be received in at least rotary power tool, wherein the cover (4) is dimensioned, with respect to a set excitation frequency, for forming a whole number of maximum amplitude oscillations of a concentric flexural oscillation, wherein the cylindrical tube (3) is dimensioned, with respect to said set excitation frequency, for forming a whole number of maximum oscillations of axial longitudinal oscillations, wherein the cover (4) has a concentric projection (9) in a vicinity of a location of a nodal circle (7) of amplitude oscillations of the concentric flexural oscillation (8), wherein the cover (4) has a concentric projection (9) in a vicinity of a location of a nodal circle (7) of amplitude oscillations of the concentric flexural oscillation (8), and wherein the cylindrical tube (3) has, solely in an axial region (X) of axial longitudinal amplification oscillation nodes (1), a plurality of elongate recesses (11) oriented along the central axis (A) and equidistantly arranged over a circumference of the cylindrical tube (3).

5. A core bit according to claim 4, wherein the recesses (11) are located at at least one of one-fourth and three-fourths of a relative length of the cylindrical tub (3).

6. A core bit for an abrasive cutting of mineral components, comprising a cylindrical tube (3) provided at an end surface thereof with one of cutting bodies an abrasive bodies (2); and a cover (4) provided at an opposite end surface of the cylindrical tube (3) and secured thereto and having, along a central axis (A) thereof, a shank (5) to be received in at least rotary power tool, wherein the cover (4) is dimensioned, with respect to a set excitation frequency, for forming a whole number of maximum amplitude oscillations of a concentric flexural oscillation, wherein the cylindrical tube (3) is dimensioned, with respect to said set excitation frequency, for forming a whole number of maximum oscillations of axial longitudinal oscillations, and wherein the cover (4) has a collar (12) projecting radially beyond the cylindrical tube (3), and wherein the collar (12) projects radially beyond the cylindrical tube (3) by a one-fourth of a wave length of the flexural oscillation (8).

* * * * *